US006659065B1

(12) United States Patent
Renegar

(10) Patent No.: US 6,659,065 B1
(45) Date of Patent: Dec. 9, 2003

(54) FLEXIBLE VANE ROTARY ENGINE

(76) Inventor: David C Renegar, 253 Brook Pines Dr., Apt. 10315, Columbia, SC (US) 29210

( * ) Notice: Subject to any disclaimer, the term of this patent is extended or adjusted under 35 U.S.C. 154(b) by 0 days.

(21) Appl. No.: 10/216,948

(22) Filed: Aug. 12, 2002

(51) Int. Cl.[7] ..... F02B 53/04
(52) U.S. Cl. ..... 123/227; 123/243; 123/236; 418/152; 418/153; 418/154; 416/240
(58) Field of Search ..... 123/227, 236, 123/243; 418/152, 153, 154, 158; 416/240

(56) References Cited

U.S. PATENT DOCUMENTS

| | | | | | |
|---|---|---|---|---|---|
| 1,426,954 | A | * | 8/1922 | Brooks | 416/240 |
| 2,442,783 | A | * | 6/1948 | Senn | 416/240 |
| 2,455,194 | A | * | 11/1948 | Rumsey | 418/154 |
| 2,487,685 | A | * | 11/1949 | Young | 418/152 |
| 2,899,902 | A | * | 8/1959 | Bandli et al. | 418/154 |
| 3,053,190 | A | * | 9/1962 | Carlson | 418/154 |
| 3,585,973 | A | * | 6/1971 | Klover | 123/243 |
| 3,614,277 | A | | 10/1971 | Kobayashi | |
| 3,964,447 | A | | 6/1976 | Normandin | |
| 4,004,556 | A | | 1/1977 | Pfeiffer | |
| 4,225,293 | A | | 9/1980 | Lee | |
| 4,392,779 | A | * | 7/1983 | Bloemers et al. | 418/154 |
| 4,702,205 | A | * | 10/1987 | David | 123/236 |
| 5,082,293 | A | | 1/1992 | Steinetz et al. | |
| RE33,919 | E | * | 5/1992 | Kristoff et al. | 418/153 |
| 5,222,466 | A | | 6/1993 | Gratziani | |
| 5,397,224 | A | | 3/1995 | Bando et al. | |
| 5,415,141 | A | | 5/1995 | McCann | |
| 5,474,043 | A | | 12/1995 | Mallen | |
| 5,660,536 | A | * | 8/1997 | Karls et al. | 418/152 |
| 6,003,486 | A | | 12/1999 | Vanmoor | |
| 6,125,814 | A | | 10/2000 | Tang | |
| 6,164,263 | A | | 12/2000 | Saint-Hillare et al. | |
| 6,264,450 | B1 | * | 7/2001 | Woodruff | 418/153 |

FOREIGN PATENT DOCUMENTS

| | | | | |
|---|---|---|---|---|
| DE | 3322933 A1 | * | 1/1985 | 418/154 |
| GB | 2212862 A | * | 8/1989 | 418/154 |
| JP | 02125991 A | * | 5/1990 | 418/152 |

OTHER PUBLICATIONS

Article entitled "FutureWatch: From the Piston to the Wankel to the Quasiturbine" published on the webpage http://www.futureenergies.com/article.php?sid=32 discusses the advantages of the Quasiturbine Rotary Engine. The associated website page accompanying this document was printed on Oct. 29, 2002.

Presentation entitled "The Influence of Light Weight Materials on Fuel Economy and Emissions in Heavy Duty Diesel Engine" as part of the Diesel Engine Emissions Reduction Workshop in San Diego, California and prepared by Becker, Myers, and Chen of Cummins Inc, discusses the effects of using lighter materials, such as aluminum, in diesel engines.

(List continued on next page.)

*Primary Examiner*—Thomas Denion
*Assistant Examiner*—Thai-Ba Trieu
(74) *Attorney, Agent, or Firm*—Michael A. Mann; Nexsen Pruet Jacobs & Pollard, LLC

(57) ABSTRACT

An internal combustion rotary engine that employs resilient, flexible vanes attached to a rotor that spins within an oval cavity in a housing. The vanes, which are long enough to extend slightly radially from the rotor by a distance beyond the interior surface of the cavity, bend in response to the cyclical variation between the rotor and the oval cavity in order to define four chambers and form a sliding seal with the interior surface. As the vanes revolve with the rotating rotor, the volumes of these four chambers vary cyclically and enable the four phases of an approximate Otto Cycle. The engine is more efficient than a conventional, reciprocating engine because the expansion force of the combustion gas acts directly on the rotating element with a minimum of moving parts.

18 Claims, 3 Drawing Sheets

OTHER PUBLICATIONS

Article entitled "The Rand Cam/Direct Charge Engine" published by Reg/Regi Technologies, Inc. and found on the website http://www.regtech.com discloses significant features of the Rand Cam rotary engine. The associated website page accompanying this document was printed on Oct. 29, 2002.

Article entitled "'ELROTARY'—A New Type Engine Gas Diesel or Hydrogen Engine" published by 21st Century Engines, Inc and found on the website http://iland.net discloses significant features of the one cycle rotary engine that the article claims was patented in 1996. The associated website page accompanying this document was printed on Oct. 29, 2002.

Webpage entitled "Frasca Rotary Engine (FRE) Characteristics" found on the webpage http://frascapublications.com/engine1.htm discloses a Frasca Rotary engine. The webpage contains the following copyright notice– "The contents of this page are from 'Elements of Frasca Rotary Engine Design' Copyright © 1998 by Joseph F. Frasca". The associated website page accompanying this document was printed on Oct. 29, 2002.

Webpage entitled "2nd Inventors' Olympiad—Genius 2000 Budapest, Virtual Exhibition" found on the website http://www.inventor.hu shows a Rotary–Vane Internal Combustion Engine as registry No. F–167. The engine shown uses two rotary vane pairs in the cylinder instead of an alternate motion piston. The associated website page accompanying this document was printed on Oct. 29, 2002.

The webpage http://www.globalcreativedynamics.com/2.htm shows a hydrogen powered rotary engine showing a dual rotor engine. The website claims that the engine is patented and contains the following notice—"Notice: U.S. Patent (6,129,067) was recently granted and may be found by clicking here." The associated website page accompanying this document was printed on Oct. 29, 2002.

The article "The Rotary Opposed Piston Engine®" published on the website http://www.ropengine.20m.com/ discloses a rotary engine that allows fuel to be burned without a change in cylinder volume. The website has the following copyright notice—"©Copyright 2001 QuietPower, All Rights Reserved". The associated website page accompanying this document was printed on Oct. 29, 2002.

The webpage http://www.mcmastermotor.com/concept.htm discloses a two cycle rotary engine with a high power to weight ratio that uses hydrogen as a fuel. The website has the following copyright notice—"Copyright © 2000 McMaster Motor". The associated website page accompanying this document was printed on Oct. 29, 2002.

The report "The Ball Piston Engine: A New Concept in High Efficiency Power Machines" by Rory R. Davis published on the webpage http://www.ballpistonengine.com/report.html discloses a rotary engine using balls as pistons attached to a stator inside a spinning rotor. The associated website page accompanying this document was printed on Oct. 29, 2002.

The website http://www.pelleja.com/discloses a rotary internal combustion engine that relies on rigid vanes attached to a central rotor and claims protection from US Patent 6,247,443 B1. The associated website page accompanying this document was printed on Oct. 29, 2002.

The website http://www.idolmotor.8m.com/ discloses a rotary engine using the Idol principle. The engine disclosed appears to be a two–stage design using a compressor and turbine. The associated website page accompanying this document was printed on Oct. 29, 2002.

The webpage http://www.dself.demon.co.uk/rotaryengines/rotaryeng.htm gives background information on stream powered rotary engines and pumps. The associated website page accompanying this document was printed on Oct. 29, 2002.

The paper entitled "Analysis of the Vading Concept—a new rotary–piston compressor, expander, and engine principle" by Ivar S. Ertesag published Jul. 16, 2001 from the Norwegian University of Science and Technology, discloses a rotary engine with multiple vanes that slide into slots within a central rotor.

The webpage http://www.grc.nasa.gov/WWW/structuralseal/InventYr/1996Inv_Yr.htm describes a seal developed for high temperature applications. The associated website page accompanying this document was printed on Oct. 29, 2002. The seal described on this website is also shown in a turbine application in the accompanying bulletin entitled "Turbomachinery TM–070–1".

The article Titanium Matrix Composite Turbine Engine Component Consortium (TMCTECC) published on the webpage http://www.allstar.fiu.edu/aero/tmctecc.htm and written by Ralph E. Anderson discloses some of the benefits of using titanium matrix composites in turbine engines and how such composites are expected to become more affordable in the future. The website has the following copyright notice–"© 1995–2002 ALLSTAR Network. All rights reserved worldwide." The associated website page accompanying this document was printed on Oct. 29, 2002.

The webpage http://www.dtic.mil/dpatitle3/titanium.htm discloses a government project with a goal of promoting the development of Titanium Metal Matrix Composites. The associated website page accompanying this document was printed on Oct. 29, 2002.

The website http://www.almmc.com/describes a consortium whose mission is to facilitate expanded application of reinforced aluminum and other metal matrix composite products. The associated website page accompanying this document was printed on Oct. 29, 2002.

The technical paper entitled "Metal Matrix Composite Materials for Net Shape Fabrication of Various Heat Sink Substrates and Packages" published on the webpage http://www.aavidthermalloy.com/technical/papers/matrix.shtml by AAVID Thermalloy LLC. The webpage has the following copyright notice–"©2002 Aavid Thermalloy, LLC." The associated website page accompanying this document was printed on Oct. 29, 2002.

The technical paper entitled "Heavy Vehicle Technologies—High Strength Weight Reduction Materials" published on webpage http://www.ornl.gov/ORNL/Energy_Eff/transp4a.html discusses the advantages of metal composites in vehicle weight reduction. The associated website page accompanying this document was printed on Jun. 4, 2002.

The webpage http://www.swri.org/3pubs/brochure/d09/UAVT/uavt.htm is a brochure published by the Southwest Research Institute discussing unmanned aerial vehicles. The brochure was published in Feb. 1999.

The technical bulletin "High Strength Aluminum Casting Alloy for High Temperature Applications" published by the Best Manufacturing Practices Center of Excellence originally on Apr. 26, 1999 on the webpage http://www.bmpcoe-.org/bestpractices/internal/nasam/nasam_30.html discloses a high strength aluminum–silicon alloy. The associated website page accompanying this document was printed on Jun. 6, 2002.

The technical bulletin "High Strength and Wear–Resistant Aluminum Alloy" published by the NASA Technology Applications Team discloses the NASA 398 Aluminum alloy for high strength applications.

The article "Small Aircraft Propulsion: The Future is Here" published by NASA on the webpage http://www.grc.nasa.gov/WWW/PAO/PAIS/fs01grc.htm discusses several new engines adapted for general aviation and the general need for new engines adapted for light aviation. The associated website page accompying this document was printed on Jun. 4, 2002.

The technical excerpt "DVD Modifications for YSZ Deposition" discloses general background information regarding the availability of high strength yttria stabilized zirconia coatings for metallic surfaces.

The webpage http://www.zircarzirconia.com/ZYW30A.htm discloses background information on the use of zirconia as a cloth of flexible material. The webpage contains the following notice—Copyrights and trademarks are the property of ZIRCAR Zirconia, Inc.

The catalog pages from HPA Alloys of Tipton, Indiana, disclose various high strength materials. The pages also list a website http://www.hpalloy.com/index.html.

* cited by examiner

FLEXIBLE VANE ROTARY ENGINE

CROSS REFERENCE TO RELATED APPLICATIONS

Not Applicable

STATEMENT REGARDING FEDERALLY SPONSORED RESEARCH OR DEVELOPMENT

Not Applicable. REFERENCE TO A SEQUENCE LISTING, A TABLE, OR A COMPUTER PROGRAM LISTING COMPACT DISK APPENDIX Not Applicable.

FIELD OF THE INVENTION

The present invention relates generally to internal combustion engines using thermodynamic cycles such as the Otto Cycle or Diesel Cycle, and, in particular, to rotary engines.

BACKGROUND OF THE INVENTION

The internal combustion engine releases the potential energy stored in fuel, such as gasoline, by burning the fuel and providing a means to convert the gases released by combustion, which expand according to the Otto Cycle or the Diesel Cycle, into mechanical energy.

In the last century, the means by which the gas expansion force has been converted into mechanical energy has been the focus of much development and refinement. Traditional engine designs have concentrated on the reciprocating engine that allows the expanding gas to act on the rotating element such as a shaft indirectly through a piston and rod. As the gas expands, pressure is exerted on a piston in a cylinder and the piston is forced downward. A rod attached to the piston transmits the downward force to a crankshaft. The force acts tangential to the rotation of the shaft and creates a torque on the shaft. In response to the torque applied to the shaft, the shaft begins to turn. While this arrangement is a venerable one, it has shortcomings due to large mass to low power ratio, high friction due to many moving parts, low relative speed, and high cost due to complexity of the assembly.

These shortcomings have pushed inventors toward developing rotary engines where the expanding gas is applied directly to the rotating element that produces mechanical energy instead of through pistons, rods, and crankshafts. A rotary engine typically has a rotor that turns inside a housing, and is either directly connected to a shaft, which is analogous to the crankshaft in a reciprocating engine, or is connected to a shaft through a planetary gear system. Many practical rotary designs have used a specially-shaped cavity inside a housing and a gear system to allow the rotor to follow the contours of the cavity to achieve the expansion and compression phases of the Otto Cycle. The planetary gear rotary engine is also proven and refined, but it has several limitations such as epitrochoidal housing shapes requiring complicated machining and rotor seals.

Simpler rotary engine geometries exist including engines employing oval-shaped interior housing cavities. The oval cavity shape allows direct attachment of the rotor to the shaft, thereby eliminating the planetary gears and increasing the efficiency. The rotors are smaller and use thin vanes that respond to the oval cavity and allow for the dimensional changes of the control volume. Until now, such arrangements have relied on rotors with special slots where the vanes retract mechanically into the rotor. This system is complicated and requires additional moving parts, such as bearings, and machining steps.

Therefore, the need exists for an engine that offers (1) direct conversion of chemical energy to rotational mechanical energy (2) direct connection of the rotor to the shaft and (3) a minimum of moving and machined parts.

SUMMARY OF THE INVENTION

The present invention is a rotary engine that uses plural, resilient, flexible, equally distributed vanes fixed to a central hub, or rotor. The invention is also a vehicle with the improved rotary engine and a rotor assembly. In one application, the vehicle is a drone airplane, however, other applications such as helicopters, boats, and land-based vehicles are possible where a drive train, with a transmission and wheels, is used instead of a propeller. The essential elements of the vehicle are a frame to which the engine is mounted, a means for controlling the engine such as a servo or cable control connected to a throttling valve, and an output means such as a propeller or drive train to convert the engine output shaft work into vehicle propulsion.

The engine output shaft is connected to the rotating element of the rotary engine. In the preferred embodiment, the rotating element is a rotor, which directly turns the output shaft centered in the engine housing having an oval-shaped interior cavity surface and four equally spaced vanes. However, a stationary rotor in a rotating housing is also possible as was shown by some of the earliest inventions of Dr. Felix Wankel.

In the preferred embodiment, the oval housing cavity shape causes the distance between the interior surface of the housing cavity and the shaft center at the nearest point to vary cyclically as the shaft and rotor turn. The resilience and flexibility of the vanes allows for bending of the vanes as the shaft rotates while the vanes resiliently adapt to the cyclical variation in the radial distance between the interior surface of the housing cavity and shaft center. The vanes bend away from the direction of rotation. Contoured recesses in the rotor receive the vanes, anchoring them so they do not separate from the rotor and allowing the vanes to flex in cooperation with the housing. The cooperation between the vanes and the housing is such that the vanes form a movable seal with the housing interior surfaces and define a number of chambers equal to the number of vanes. The cyclical variation in distance changes the volume of each chamber cyclically to accomplish the four-phase internal combustion cycle approximating the Otto Cycle.

The four phases of engine operation are:

(1) Intake—rotating vanes sweep an expanding fluid, such as an air-fuel vapor mixture, into the engine through an intake port in the housing. The air-fuel vapor mixture is delivered through carburetors or various fuel injection arrangements typical of combustion engines.

(2) Compression—the expanding fluid is compressed. The vanes move the expanding fluid in orbit around the hub so that the chamber volume decreases, the vanes bending in reaction to a decreasing radial distance between the rotor and the interior surface of the housing cavity.

(3) Combustion/Expansion—at maximum compression, an expansion-initiating means such as a spark plug, glow plug, or compression ignition ignites the air/fuel mixture. The expansion initiating means can be simply a threaded hole or an entire pre-combustion chamber with multiple spark plugs. The resulting combustion causes the compressed mixture to combust which in turn causes the products of combustion, namely gases, to expand, causing a force to be applied to the vanes. The applied force creates a torque on the rotor and shaft. Power is transmitted through the shaft to perform work.

(4) Exhaust—the expanding fluid has fully expanded and combustion has been fully accomplished. Residual gases are swept along by the vanes to an exhaust port and are vented to the atmosphere.

In the preferred embodiment, gasoline will be used as a fuel and a spark plug will be used as the expansion initiating means. However, any number of conventional fuels may be used including hydrogen, methane, alcohol, propane, and diesel fuel. It is foreseeable that such other fuels may require changes to the expansion initiating means as well, including a pre-combustion chamber to obtain a more complete combustion of leaner fuel mixtures.

Housings and rotors made of other materials besides metal, such as thermoplastics, are also possible, as are parts coated with friction reducing compounds. Lightweight materials would complement the rotary engine's benefits of high power to weight ratio and simplicity. The low friction components would also complement the rotary engine's efficiency.

It is also conceived that the engine could operate using other thermodynamic cycles such as the Diesel Cycle, or as a pump as the expansion initiating means could be a tube that would supply high-pressure fluid to the expansion chamber.

These and other features and their advantages will be clear to those skilled in the art of rotary engine design and fabrication from a careful reading of the Detailed Description of the Preferred Embodiments, accompanied by the following drawings.

DETAILED DESCRIPTION OF THE PREFERRED EMBODIMENTS

Figure 1:
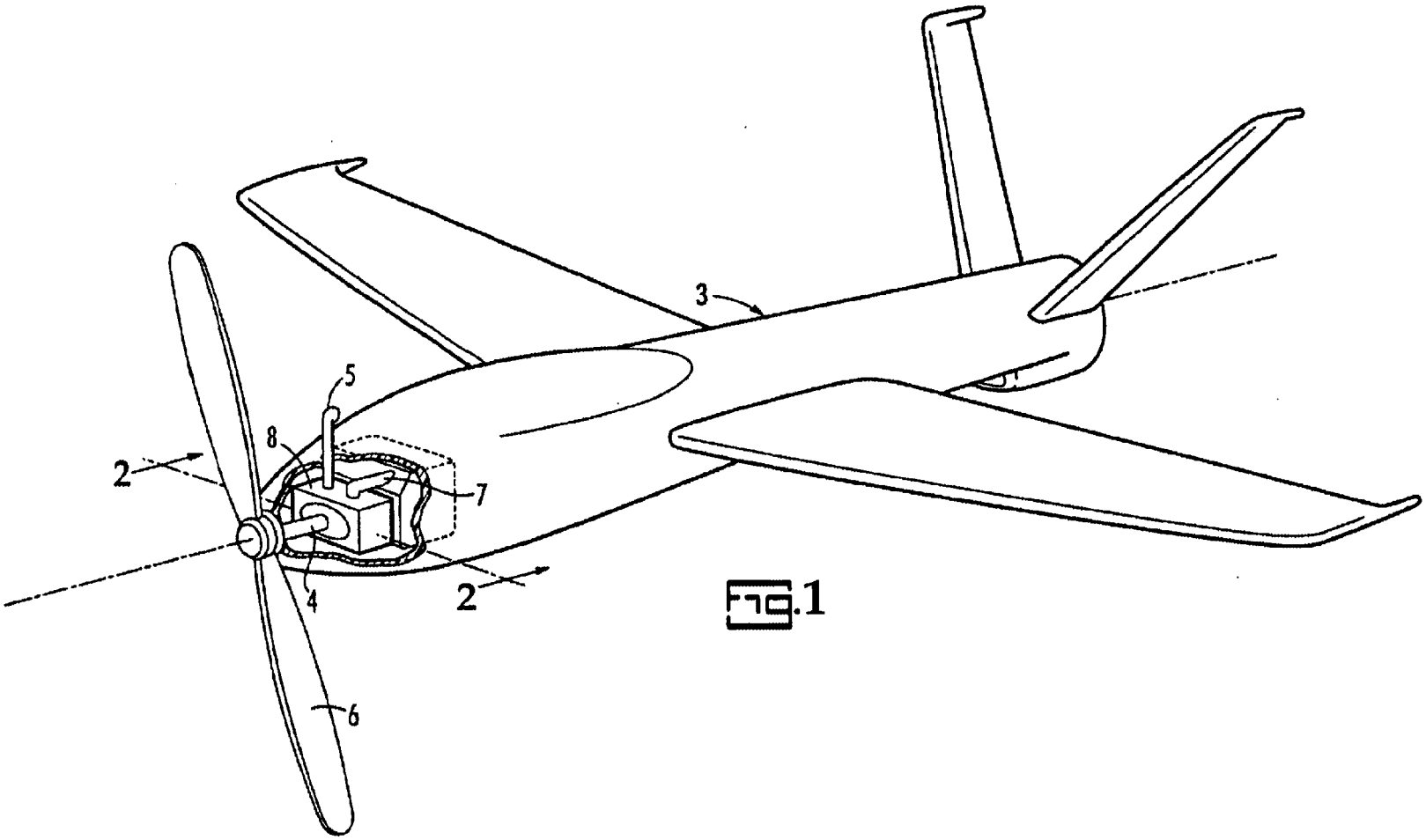
FIG. 1 is a perspective view of a small, drone airplane to illustrate an application of an engine, according to a preferred embodiment of the present invention.

Referring now to the drawings, FIG. 1 shows the present engine mounted in a small, drone airplane. The engine housing 8 is fixed to the airframe 3. Housing 8 also carries the intake and exhaust ports that are shown as intake pipe 7 and exhaust pipe 5. Servos meter the air and fuel delivery to control the engine. The servos are controlled remotely by radio frequency or other common remote control system. The housing contains a rotor 18 that converts the air-fuel mixture to mechanical energy by combustion and expansion of the combustion gases against the vanes. Rotor 18 is connected to the output shaft 4 that carries the power created in the engine to the output means 6. In the case of the drone airplane such output means is a propeller.

There are many other applications for the present engine. For example, almost any small engine including those in lawn care equipment such as lawn mowers and trimmers, small vehicles such as motor scooters and golf carts, and industrial equipment such as pumps and compressors. With suitable choices of materials, the present engine may be used where greater power is required as well.

Figure 2A:
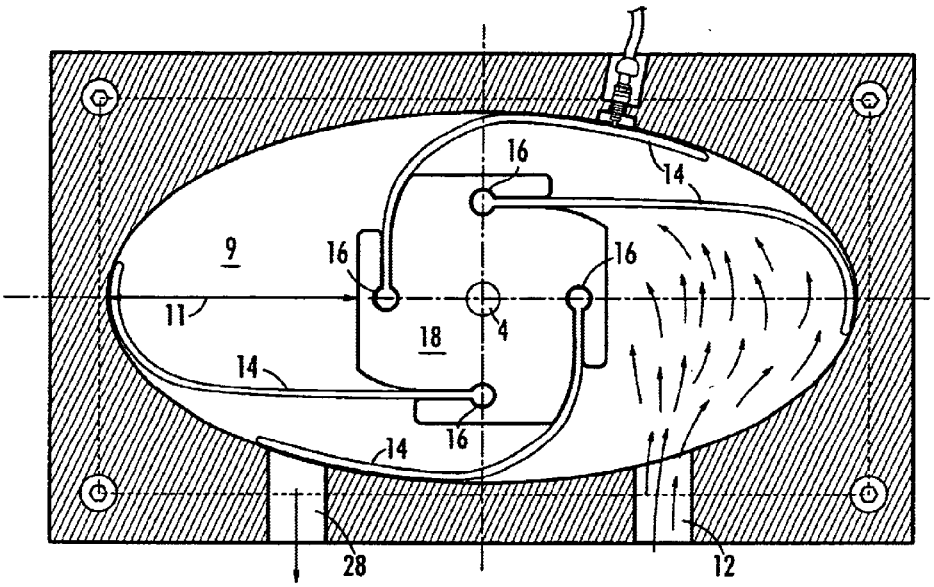
FIG. 2*a–d* shows front views of an engine during the four phases of the Otto Cycle, according to a preferred embodiment of the present invention.

FIG. 2*a* shows a cutaway view of the engine through housing 8 during the intake phase, which is the first phase of engine operation. During this phase, the position of two of the four, 90°-separated vanes 14 coincide approximately with the greatest radial distance 11 between the surface of rotor 18 and the housing cavity inner surface.

If housing 8 has an oval interior cavity surface, it will have a major dimension along the major axis and a minor dimension along the minor axis of the oval. Vanes 14 will sweep along the interior cavity surface as they are revolved with rotating rotor 18.

The air-fuel mixture 10 (represented by arrows) is delivered through the intake pipe to the intake port 12 by low pressure created as the plural resilient, flexible vanes 14 extending towards the radial distance 11 to engage the surface of housing cavity 9 regardless of the orientation of rotor 18 in housing 8, since vanes 14 are dimensioned to exceed the maximum distance from rotor 18 to the interior cavity surface.

The recesses 16 in the rotor 18 allow the vanes 14 to bend while revolving inside the housing cavity 9. During each revolution within housing 8, each vane 14 moves cyclically through two minimum radial distances to the interior cavity surface and two maximum distances, a maximum distance followed by a minimum followed by another maximum. As rotor 18 rotates, the volume defined between any two adjacent vanes 14, alternates between a larger and a smaller volume, allowing the fluids contained with the volume to be compressed and then expanded. Rotor 18 also cooperates with the output shaft 4 so that shaft 4 rotates when rotor 18 rotates with respect to housing 8.

Figure 2B:
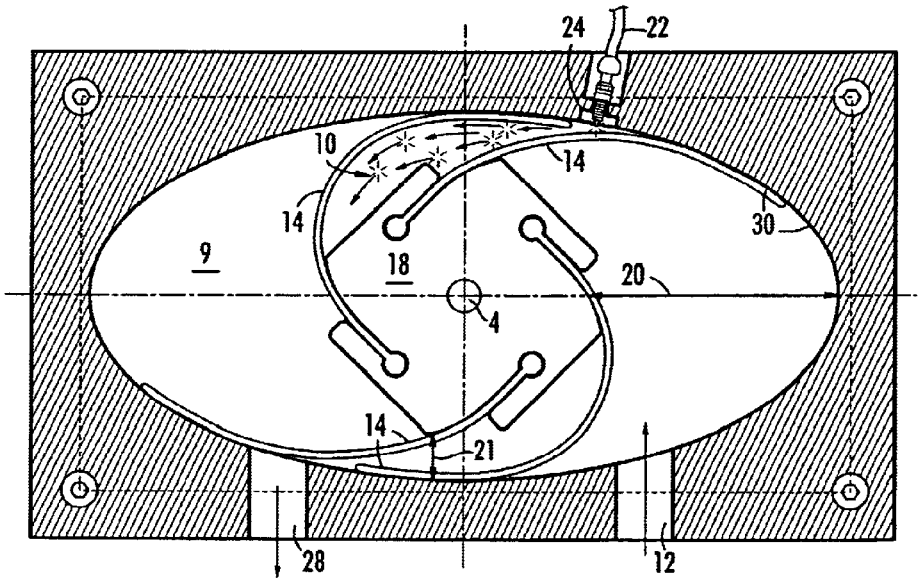

FIG. 2*b* shows a cutaway view of the engine through housing 8 during the compression phase. As vanes 14 revolve toward the minimum radial distance 21 between the rotor surface and the housing cavity inner surface, vanes 14 bend resiliently and flexibly away from the direction of rotation while compressing the air-fuel mixture 10. The maximum compression point occurs approximately when one vane 14 reaches the minor diameter axis of the oval shaped cavity. At approximately this point, the expansion initiating means 22 at expansion initiating port 24 is operated and the air-fuel mixture 10 is ignited.

Figure 2C:
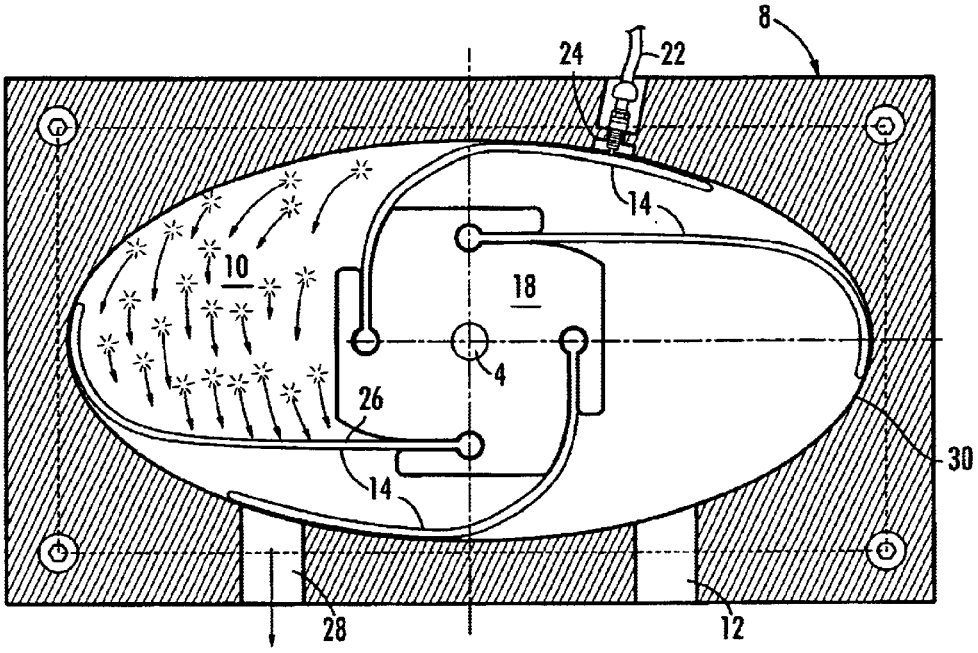

FIG. 2*c* shows a cutaway view of the present engine through housing 8 during the combustion/expansion phase. After the compression phase, the expansion initiating means causes the combustion of the air/fuel mixture 10. The resulting combustion gases expand and apply a force to the trailing surface 26 of vane 14. The force is transmitted to the base of the vane 14, acting tangentially to rotor 18, causing a rotational torque on output shaft 4.

Figure 2D:
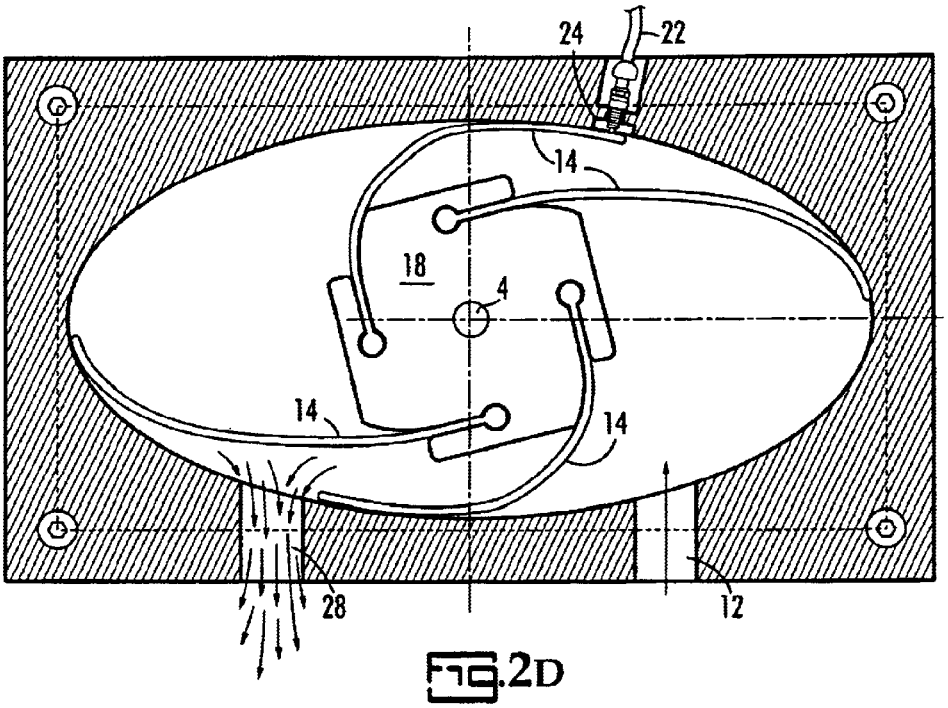

FIG. 2*d* shows a cutaway view of the engine through housing 8 during the exhaust phase. After the expansion phase, vanes 14 sweep the spent combustion gases towards exhaust port 28. Since exhaust port 28 roughly coincides with the second point where the distance between rotor 18 and the interior cavity surface of housing 8 is at a minimum, the decreasing volume occurring at this point forces the exhaust gases out to the lower pressure atmosphere.

Housing 8 and rotor 18 are preferably made of metal or metal alloy but may be made of a composite material capable of withstanding the heat and pressure of the interior of the present engine. Vanes 14 are preferably made of a resilient, flexible material such as spring steel, Monel, Inconel, Titanium, plastic, laminated metal, or a composite using various fibers such as ceramic, zirconia, or metal. Ideally, the leading surface of vanes 14 and the interior cavity surface 30 carry low friction coatings.

Finally, those skilled at designing and building engines will recognize that substitutions and modifications can be made in the foregoing preferred embodiments without departing from the spirit and scope of the present invention.

What is claimed is:

1. A rotary engine, comprising:

(a) a housing with an interior cavity surface, an intake port and an exhaust port;

(b) means for initiating expansion of a fuel, said expansion initiating means carried by said housing;

(c) a rotor positioned within said housing and adapted to rotate relative to said housing;

(d) a shaft extending outside said housing and being in operational connection with said housing and said rotor so that when there is relative motion between said housing and said rotor, said shaft rotates; and (e) resilient, flexible vanes carried by said rotor and extending from said rotor radially to engage said interior cavity surface of said housing so that, when said rotor rotates with respect to said housing, said vanes remain in engagement with said interior cavity surface, wherein a minimum distance between said rotor and said interior radial surface varies cyclically with rotation of said housing relative to said rotor, and said minimum distance occurs twice within each rotation of said rotor with respect to said housing.

2. The rotary engine as recited in claim 1, where said interior cavity surface is oval.

3. The rotary engine as recited in claim 1, wherein said shaft is adapted to rotate with said rotor.

4. The rotary engine as recited in claim 1, wherein said expansion initiating means is selected from the group consisting of a spark plug, glow plug, and compression ignition.

5. The rotary engine as recited in claim 1, wherein said interior cavity surface carries a low friction material.

6. The rotary engine as recited in claim 1, wherein said vanes include four vanes.

7. The rotary engine as recited in claim 1, wherein said vanes are evenly distributed about said rotor.

8. A rotor for a rotary engine having a housing with an interior cavity surface rotary engine, comprising:

(a) a rotor having recesses formed therein; and (b) resilient, flexible vanes received within said recesses, said vanes extending outwardly from said rotor to said interior cavity surface to define chambers when said rotor is inserted within said housing, wherein a minimum distance between said rotor and said interior radial surface varies cyclically with rotation of said housing relative to said rotor, and said minimum distance occurs twice within each rotation of said rotor with respect to said housing.

9. The rotor as recited in claim 8, wherein said vanes have a length that exceeds the maximum distance from said rotor to said interior cavity surface.

10. The rotor as recited in claim 8, wherein said vanes includes four vanes deployed at right angles with respect to each other about said rotor.

11. A vehicle having a frame, an engine, an output shaft, a means for controlling said engine, and output means in operational connection with said shaft, said output means adapted to propel said frame, said output means responsive to said control means, wherein the improvement comprises:

(a) an engine housing having an interior cavity surface;

(b) said engine housing having an intake port, an exhaust port, and a means for initiating expansion of a fuel;

(c) a rotor mounted within said housing and in operational connection with said shaft; and (d) flexible, resilient vanes carried by said rotor, said vanes engaged with said interior cavity surface thus defining chambers, wherein a minimum distance between said rotor and said interior radial surface varies cyclically with rotation of said housing relative to said rotor, and said minimum distance occurs twice within each rotation of said rotor with respect to said housing.

12. The vehicle as recited in claim 11, wherein said interior cavity surface is an oval.

13. The vehicle as recited in claim 11, wherein said vanes include four vanes.

14. An engine, comprising:

(a) a housing having an oval interior cavity with an interior surface, said housing having a hole, an intake port and an exhaust port formed therein;

(b) an output shaft extending from said oval interior cavity-through said housing and exterior to said housing;

(c) a rotor rotatably mounted within said housing and in operational connection with said output shaft so that, as said rotor rotates, said output shaft rotates;

(d) flexible, resilient vanes carried by said rotor, said vanes engaged with said interior surface as said rotor rotates within said housing, thus defining chambers therebetween, said chambers alternately increasing and decreasing in size twice as said vanes rotate once within said housing;

(e) means for receiving fuel within said chambers through said intake port; and (f) means for initiating expansion of said fuel when said fuel is received within said chambers, said expanded fuel venting through said exhaust port of said oval housing.

15. The engine as recited in claim 14, wherein said flexible, resilient vanes includes at least four vanes equally spaced about said rotor.

16. The engine as recited in claim 14, wherein said initiating means is selected from the group consisting of spark plugs, glow plugs, and compression ignition.

17. The engine as recited in claim 14, wherein said interior surface carries a low-friction material.

18. The engine as recited in claim 14, wherein said vanes have a length that exceeds the maximum distance from said rotor to said interior surface of said housing.

* * * * *